US005957774A

United States Patent [19]

Holmes, Jr. et al.

[11] Patent Number: 5,957,774

[45] Date of Patent: Sep. 28, 1999

[54] METHOD OF PLAYING AN ELECTRONIC VIDEO CARD GAME

[76] Inventors: Verne F. Holmes, Jr., 8625 Rosada Way, Las Vegas, Nev. 89121; Linton Mathews, 6621 Cowboy Trail, Las Vegas, Nev. 89131

[21] Appl. No.: 09/257,157

[22] Filed: Feb. 24, 1999

Related U.S. Application Data

[63] Continuation of application No. 08/837,713, Apr. 22, 1997, Pat. No. 5,882,259, and a continuation-in-part of application No. 08/413,253, Mar. 30, 1995, abandoned

[60] Provisional application No. 60/015,912, Apr. 22, 1996.

[51] Int. Cl.[6] ..... A63F 1/00

[52] U.S. Cl. ..... 463/13; 273/292

[58] Field of Search ..... 273/292; 463/13, 463/12

[56] References Cited

U.S. PATENT DOCUMENTS

| | | | |
|---|---|---|---|
| 4,948,134 | 8/1990 | Suttle et al. | 463/13 |
| 5,042,818 | 8/1991 | Weingardt | 463/13 |
| 5,100,137 | 3/1992 | Fulton | 463/13 |
| 5,415,414 | 5/1995 | Savage | 273/306 |
| 5,511,781 | 4/1996 | Wood et al. | 463/13 |

*Primary Examiner*—Benjamin H. Layno
*Attorney, Agent, or Firm*—John Edward Roethel

[57] ABSTRACT

Traditional video poker is modified by paying the player a first winning amount if a predesignated arrangement of cards are achieved by the player on the deal. After the first winning amount is paid if won by the player, the game continues with the player holding or discarding as desired from the initial deal and replacement cards are provided to the player to establish the player's final hand. The player is paid a second amount if the player achieves a winning combination on his final hand. Traditional video poker is alternatively modified by the addition of Four to a Royal Flush as a winning hand. A player receives a higher payout if he achieves Four to a Royal Flush on the initial deal of five cards. A player receives a lower payout if he achieves Four to a Royal Flush after he has drawn replacement cards. Another variation comprises first displaying to the player all fifty-two cards of a conventional deck of cards. The player then selects five of the fifty-two cards and these cards are considered the player's matching cards. The player is then dealt his five card draw poker hand. If some or all of the initial five card draw poker cards match the cards selected by the player by card rank and/or card position, then the player is awarded one of a series of payouts.

99 Claims, 7 Drawing Sheets

1 TO 5 COINS PAYS AFTER THE DRAW

| | 1st COIN | 2nd COIN | 3rd COIN | 4th COIN | 5th COIN |
|---|---|---|---|---|---|
| ROYAL FLUSH | 250 | 500 | 750 | 1000 | 4000 |
| 4 Aces w/any 2,3or4 | 400 | 800 | 1200 | 1600 | 200 |
| 4 2's,3's & 4's w/any Ace,2,3or4 | 160 | 320 | 480 | 640 | 800 |
| 4 of a Kind (Ace's) | 160 | 320 | 480 | 640 | 800 |
| 4 of a Kind (2's,3's & 4's) | 80 | 160 | 240 | 320 | 400 |
| 4 of a Kind (5's thru k's) | 50 | 100 | 150 | 200 | 250 |
| Straight Flush | 50 | 100 | 150 | 200 | 250 |
| Full House | 9 | 18 | 27 | 36 | 45 |
| Flush | 6 | 12 | 18 | 24 | 30 |
| Straight | 4 | 8 | 12 | 16 | 20 |
| 3 of a Kind | 3 | 6 | 9 | 12 | 15 |
| 2 Pair | 1 | 2 | 3 | 4 | 5 |
| Pair of Jacks or Better | 1 | 2 | 3 | 4 | 5 |

| 1 TO 5 COINS PAYS AFTER THE DRAW | | | | | |
|---|---|---|---|---|---|
| | 1st COIN | 2nd COIN | 3rd COIN | 4th COIN | 5th COIN |
| ROYAL FLUSH | 250 | 500 | 750 | 1000 | 4000 |
| 4 Aces w/any 2,3or4 | 400 | 800 | 1200 | 1600 | 200 |
| 4 2's,3's & 4's w/any Ace,2,3or4) | 160 | 320 | 480 | 640 | 800 |
| 4 of a Kind (Ace's) | 160 | 320 | 480 | 640 | 800 |
| 4 of a Kind (2's,3's & 4's) | 80 | 160 | 240 | 320 | 400 |
| 4 of a Kind (5's thru k's) | 50 | 100 | 150 | 200 | 250 |
| Straight Flush | 50 | 100 | 150 | 200 | 250 |
| Full House | 9 | 18 | 27 | 36 | 45 |
| Flush | 6 | 12 | 18 | 24 | 30 |
| Straight | 4 | 8 | 12 | 16 | 20 |
| 3 of a Kind | 3 | 6 | 9 | 12 | 15 |
| 2 Pair | 1 | 2 | 3 | 4 | 5 |
| Pair of Jacks or Better | 1 | 2 | 3 | 4 | 5 |

300

FIG-5

METHOD OF PLAYING AN ELECTRONIC VIDEO CARD GAME

CROSS-REFERENCE TO RELATED APPLICATIONS

This application is a Continuation of application Ser. No. 08/837,713, filed Apr. 22, 1997 and entitled "Method of Playing an Electronic Video Card Game," now U.S. Pat. No. 5,882,259 and is a Continuation-in-Part of application Ser. No. 08/413,253, filed Mar. 30, 1995 and entitled "Four to a Royal Poker Game," now abandoned; and a Continuation-in-Part of Provisional Application Ser. No. 60/015,912, filed Apr. 22, 1996, entitled "Electronic Video Card Game".

This invention relates to an electronic video card game, and more particularly to a card game played on an electronic gaming machine in which a player can achieve a winning payout on the initial deal of the cards if he receives one of the predesignated arrangements of cards and then the game continues so that the player may further win additional payouts.

BACKGROUND OF THE INVENTION

Video poker games have been a staple of casino gaming for quite some time. In video poker, a player wagers at least one coin or more and is dealt five cards from a standard deck of playing cards. The player then selects whether to hold the initial five cards or to discard from one to five of his initial cards. Replacement cards are dealt to the player for each card he discards. The resulting five card hand is the player's final hand and the player wins if he achieves certain poker hand combinations based on a payout schedule.

In conventional video draw poker, a typical payout schedule would be:

TABLE A

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

This payout schedule only pays based on the player's final hand. If the player receives a winning hand on the initial deal of the first five cards, the player receives exactly the same payout as the player would have received had he drawn to the same winning hand after completing the hold and draw process. in order to receive the payout for a winning hand dealt to the player on the initial deal, the player must hold all of the initially dealt cards.

Additionally, video poker payout schedules generally pay the highest payout for a Royal Flush. Typically, there is a increased amount paid for a Royal Flush with five coins wagered to encourage players to play the maximum number of coins that the game permits.

There is a need in the gaming industry to provide new and exciting games for the players to maintain interest in casino gaming. It is an object of the present invention to provide players with an additional payout whenever the player achieves a predesignated card or combination of predesignated cards on the initial deal.

It is a feature of the present invention to provide a first payout when the player is dealt one predesignated card or a combination of certain predesignated cards out of his first five cards on the initial deal and then allowing the player to continue play of the game to attempt to achieve another payout.

It is an advantage of the present invention that a new and exciting form of video poker will be provided and players will now receive payouts for achieving special cards or combinations of cards on the deal so that the player will automatically be a winner before the draw of the replacement cards even occurs.

One concept of the present invention involves paying a player a special payout for achieving Four to a Royal Flush on the initial deal. In fact, the player can be paid one level of payout if the player achieves Four to a Royal Flush on the deal and a second lower payout if the player achieves Four to a Royal Flush after he has drawn replacement cards for any cards he has discarded.

The present invention further contemplates paying a player for Four to a Royal Flush achieved on the deal and then allowing the player to continue the game to try and achieve a second winning hand. Most players who receive Four to a Royal Flush on the deal will hold these four cards, discard the fifth card and draw a fifth replacement card to attempt to achieve a five card Royal Flush. If the player successfully draws the Royal Flush, the player will receive two payouts—the first payout for being dealt Four to a Royal Flush and the second payout for drawing the Royal Flush. Even if the player is unsuccessful in drawing the Royal Flush, the player will still receive the first payout for being dealt Four to a Royal Flush.

Should the player discard all or part of the Four to a Royal Flush that was dealt to him in an attempt to achieve a different winning combination, the player still receives the first payout for being dealt Four to a Royal Flush. If the player then draws another winning combination, he also receives the second payout associated with that winning combination.

The present invention also contemplates paying the player a pre-established amount if a predesignated arrangement of one or more cards is achieved on the deal. The predesignated arrangements of cards that are winning combinations on the initial deal can take many forms. One form includes paying the player a first amount if a particular card appears during the initial deal or if a particular card appears during the initial deal at a particular location in the hand as displayed on the screen of the gaming machine. Another form includes paying the player a first amount if the initial deal includes particular one, two, three, four or five card hands (such as Four to a Royal Flush) or even various arrangements of extra cards, such as one or more Jokers, added to a standard deck of playing cards. After any winning combinations on the deal are determined and paid to the player, the player then holds and discards as he desires and attempts to achieve a second payout for a winning combination achieved after the draw.

Still another feature and variation of the present invention comprises first displaying to the player all fifty-two cards of a conventional deck of cards. The player then selects five of the fifty-two cards and these cards are considered the player's matching cards. These matching cards can be displayed to the player in a portion of the video screen display. The player is then dealt his five card draw poker hand. If some or all of the initial five card draw poker cards match the cards selected by the player by card rank, then the player is awarded one of a series of payouts. The player is awarded an even higher payout if some or all of the cards of the initial deal match the cards selected by the player not only by card rank but also by card position. Additionally, the initial five card draw poker hand can be analyzed to determine if a preselected winning combination of those cards appears.

After the initial five cards are analyzed to determine if a win has occurred on the deal, the regular five card draw poker hand is then played out to its conclusion according to the conventional manner of play for draw poker games and the player can win a second payout for certain winning combinations achieved after the draw.

It is an advantage of this variation of the present invention that a new and exciting form of video poker will be provided and players will now receive payouts for first matching cards or achieving a preselected winning combination of just the initial draw poker hand and second for achieving winning poker hands after the draw portion of the game in concluded.

Other objects, features and advantages of the present invention will become apparent from a consideration of the following detailed description.

SUMMARY OF THE INVENTION

Traditional video poker is modified by paying the player a first winning amount if a predesignated arrangement of one or more cards is achieved by the player on the deal. After the first winning amount is paid if won by the player, the game continues with the player holding or discarding as desired from the initial deal and replacement cards are provided to the player to establish the player's final hand. The player is paid a second amount if the player achieves a winning combination on his final hand after the draw.

Traditional video poker is alternatively modified by the addition of Four to a Royal Flush as a winning hand. A player receives a higher payout if he achieves Four to a Royal Flush on the initial deal of five cards. A player receives a lower payout if he achieves Four to a Royal Flush after he has drawn replacement cards. The player is also paid a second amount if the player achieves a winning combination on his final hand after the draw.

Another variation of the present invention comprises first displaying to the player all fifty-two cards of a conventional deck of cards. The player then selects five of the fifty-two cards and these cards are considered the player's matching cards. The player is then dealt his five card draw poker hand. If some or all of the initial five card draw poker cards match the cards selected by the player by card rank and/or card position, then the player is awarded one of a series of payouts.

BRIEF DESCRIPTION OF THE DRAWINGS

FIG. 5 shows an enlarged view of the lower portion of FIG. 1 showing the main pay table.

DETAILED DESCRIPTION OF THE PREFERRED EMBODIMENTS

Figure 1A:
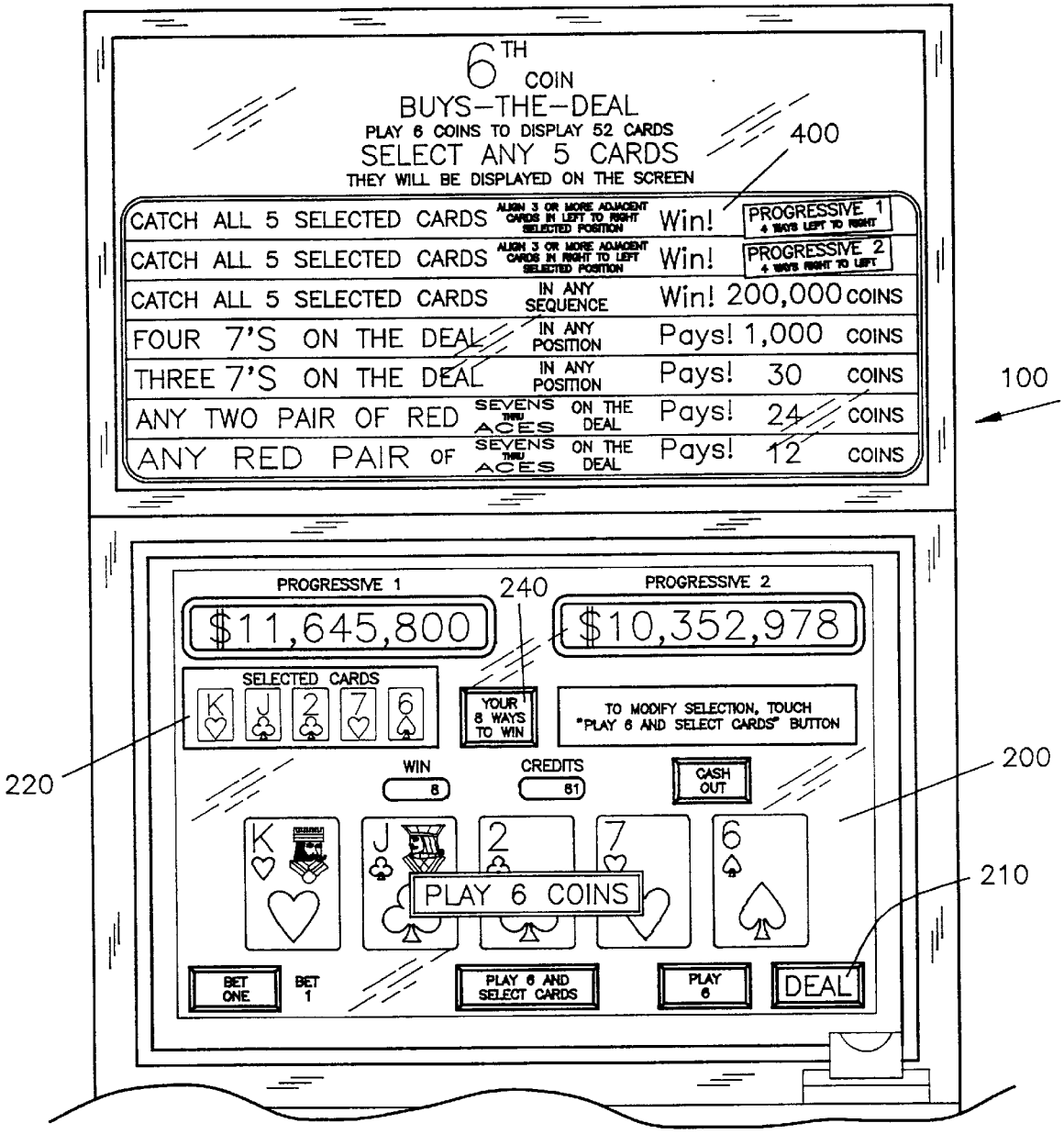
FIGS. 1A and 1B show a front view of an electronic gaming machine configured in accordance with Example 22 of the present invention.

In conventional video poker, an electronic gaming machine is programmed to display a five card hand dealt from a standard deck of fifty-two playing cards. The player bets one to five coins and activates the "Deal" button (or receives the initial deal automatically if the maximum number of coins are bet) to receive the initial deal of five cards. After the initial deal of the cards, the player may hold any of the initially dealt cards and then the player draw to receive replacement cards. The player receives a payout on the resulting hand if the player achieves one of the predesignated poker hand combinations shown on the payout schedule. The amount of the payout is based on the number of coins bet by the player. An example of a video poker method with typical payout schedules is disclosed in U.S. Pat. No. 5,042,818 (Weingardt), the disclosure of which is incorporated herein by this reference thereto.

In conventional video poker, the highest winning hand combination is a Royal Flush. A Royal Flush is the Ace, King, Queen, Jack and Ten of the same suit. The order of the cards on the display screen is irrelevant to win the conventional 4000 coin payout for a Royal Flush when the player has wagered five coins.

The method of the present invention modifies the traditional manner of play of electronic video draw poker by adding a payout based on the initial five card hand that is displayed to the player when the player activates the "Deal" button on the electronic gaming machine. Predesignated arrangements of one or more cards are considered to be winning combinations if the player receives one of these winning card combinations on the initial deal. If the player has achieved a winning combination on the initial deal, the player is paid a first predetermined amount based on a pre-established payout schedule.

Regardless of whether the player has a winning combination on the initial deal, the game continues. The player holds and discards as is conventional in electronic video draw poker. Replacement cards are displayed for the cards that have been discarded and the player is paid a second predetermined amount if the player achieves a winning combination after the draw of the replacement cards.

While the basic method of the present invention can use a wide variety of predesignated arrangements as winning arrangements for the "deal" portion of the game, a number of particular arrangements have been developed using the method of the present invention. Following are examples of these predesignated arrangements that have been developed, but the scope of the present invention is not to be limited by these examples.

EXAMPLE 1

Four to a Royal Flush

In this method of the present invention, a player will receive a first payout if the player on the initial deal achieves four of the five cards that would be required for a Royal Flush, i.e. if the player achieves Four to a Royal Flush on the initial deal of the cards. In order to win this first payout, out of the five cards that are displayed on the video screen on the initial deal, the player must have either: 1) the Ace, King, Queen and Jack of the same suit; 2) the Ace, King, Queen and Ten of the same suit; 3) the Ace, King, Jack and Ten of the same suit; 4) the Ace, Queen, Jack and Ten of the same suit; or 5) the King, Queen, Jack and Ten of the same suit. Any one of these card combinations is considered to be Four to a Royal Flush.

After it has been determined whether the player has achieved Four to a Royal Flush on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In this preferred embodiment, the player can be paid a first payout if he achieves Four to a Royal Flush on the initial deal. Additionally, the winning combinations that are paid after the draw of the replacement cards may or may not include Four to a Royal Flush as a winning hand.

If Four to a Royal Flush is also included as part of the winning combinations that are paid after the replacement cards are drawn, the payouts awarded to the player for achieving Four to a Royal Flush should vary depending on whether the player achieves Four to a Royal Flush on the initial deal or the player draws to Four to a Royal Flush. In the preferred embodiment of the present invention, if the player is dealt Four to a Royal Flush, the player receives a relatively high payout. On the other hand, if the player achieves Four to a Royal Flush after he has discarded and drawn replacement cards, the player receives a lower payout.

In order not to penalize the player for being dealt Four to a Royal Flush, it is suggested that the player immediately receive his award for being dealt a Royal Flush and then the player may also discard the fifth card and try to draw the full Royal Flush. If the player does achieve the Royal Flush on the draw, the player would receive both payouts: the payout for being dealt Four to a Royal Flush and the payout for achieving a full Royal Flush.

In the preferred embodiment, a suggested payout table for this Example 1 of the method of the present invention would be:

TABLE 1

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FOUR TO A ROYAL (DEALT) | 10 | 20 | 30 | 40 | 50 |
| FULL HOUSE | 6 | 12 | 18 | 24 | 30 |
| FOUR TO A ROYAL (DRAWN) | 5 | 10 | 15 | 20 | 25 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

It is anticipated that this payout schedule would provide an optimum player return of 96.6%. If higher optimum player returns are desired, the payout for the Full House can be increased to seven coins or even eight coins per coin wagered. Any suitable payout schedule can be used.

The method of play of Example 1 of the present invention would proceed as follows: a player would insert one to five coins or tokens (or wager credits if the gaming machine has a conventional credit meter) into an electronic gaming machine programmed to deal a game of video poker. When the player hits the "Deal" button, five cards of a standard fifty-two card deck would be displayed to the player on the video screen of the electronic gaming machine. The electronic controls of the gaming machine determine whether the player has achieved Four to a Royal Flush on the initial deal of the five card hand. If the player does achieve Four to a Royal Flush on the initial deal, the player is paid the appropriate payout for the number of coins that the player has wagered. As is conventional, this first predetermined winning amount would be added to a credit meter displayed on the screen of the gaming machine. Alternatively, the winning payout for achieving Four to the Royal on the initial deal can be dispensed immediately to the player by having the coin hopper pay out the winning amount directly into the payout tray on the gaming machine (or by issuing the player a payout slip if the gaming machine is of the type that uses a ticket slip printer).

Regardless of whether the player wins on the initial deal, the game then continues. By pressing the conventional toggle button for "Hold/Draw" on the panel of the machine beneath each card, the player would select which cards to hold and which cards to discard. When the player then hits the "Draw" button, replacement cards are displayed for the discarded cards. The electronic controls of the gaming machine determine whether a winning hand has been achieved and the player is awarded the number of coins corresponding to the winning hand and the number of coins wagered as shown in the payout schedule.

In the present invention, the player would win if the any of the card combinations shown in Table 1 are achieved. The player wins a higher amount if he is dealt Four to a Royal Flush and a lower amount if, after the draw, the player achieves Four to a Royal Flush.

As an alternative to using Four to a Royal Flush as the predesignated winning arrangement on the initial deal, it is also contemplated that Four to a Straight Flush, Four to a Flush and Four to a Straight could also be used. Similarly, Three to a Straight Flush, Three to a Flush and Three to a Straight could also be used. The use of each of these winning combinations would require adjustments to the payout schedule to reflect the frequency of any of these particular types of hands occurring on the initial deal.

The basic method of Example 1 of the present invention can also be applied to any of the other myriad forms of electronic video poker "core games" that are used on video poker machines, such as Deuces Wild Poker, Joker's Wild Poker, Deuces Joker Wild Poker, Double Bonus Poker, Double Double Bonus Poker, Triple Bonus Poker and the like. In order to provide that Four to a Royal Flush be treated as a winning hand on each of these video poker game versions, it is only necessary to mathematically compute a new payout schedule based on the frequency of each type of winning hand combination occurring and the percentage payback to the player that is desired.

EXAMPLE 2

One Eyed Jacks

Example 2 is representative of the method of the present invention in which a particular predesignated single card creates a winning arrangement if the player receives that card on the initial deal. In each deck of fifty-two standard playing cards there are two One-Eyed Jacks (the Jack of Hearts and the Jack of Spades). Either one or both of these two One-Eyed Jacks are predesignated as winning arrangements if the player is dealt one or both of the One-Eyed Jacks as part of the initial deal. If the player is dealt one One-Eyed Jack on the initial deal, the player receives a pre-established payout based on the number of coins wagered. If the player is dealt both of the One-Eyed Jacks on the initial deal, the player receives a different (and higher) pre-established amount based on the number of coins wagered.

After it has been determined whether the player has achieved one or both of the One-Eyed Jacks on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 2 of the method of the present invention would be:

TABLE 2

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| BOTH ONE-EYED JACKS (DEALT) | 10 | 20 | 30 | 40 | 50 |
| FULL HOUSE | 6 | 12 | 18 | 24 | 30 |
| ONE ONE-EYED JACK (DEALT) | 5 | 10 | 15 | 20 | 25 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

In this Example 2, the two One-Eyed jacks and the one One-eyed Jack is not a separate winning combination after the draw. Any suitable payout schedule can be used. This variation of the present invention described in Example 2 can be applied to any suitable "core game" played on a video poker machine. Furthermore, any single card can be designated as the predesignated winning card that will cause the player to receive a payout if that card is dealt to the player on the initial deal. Furthermore, another variation of this example would pay the player a particular amount if one or both of the One-Eyed Jacks are initially dealt in a particular location in the player's hand.

EXAMPLE 3

Bonus Aces

Example 3 is representative of another method of the present invention in which a one or more particular cards create a winning arrangement if the player receives those cards on the initial deal. In this example, the Aces of a standard deck of playing cards are predesignated as winning arrangements if the player is dealt one, two, three or all four of the Aces as part of the initial deal. If the player is dealt one Ace on the initial deal, the player receives a pre-established payout based on the number of coins wagered. If the player is dealt two, three or four Aces on the initial deal, the player receives different (and progressively higher) pre-established amounts based on the number of coins wagered.

After it has been determined whether the player has achieved one, two, three or four of the Aces on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 3 of the method of the present invention would be:

TABLE 3

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES (DEALT) | 50 | 100 | 150 | 200 | 250 |
| FOUR-OF-A-KIND | 25 | 50 | 75 | 100 | 125 |
| THREE ACES (DEALT) | 30 | 60 | 90 | 120 | 150 |
| FULL HOUSE | 6 | 12 | 18 | 24 | 30 |
| TWO ACES (DEALT) | 5 | 10 | 15 | 20 | 25 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| ONE ACE (DEALT) | 2 | 4 | 6 | 8 | 10 |
| JACKS OR BETTER | 1 | 2 | 3 | 4 | 5 |

In this Example 3, the one Ace is not a separate winning combination after the draw, while the two Aces, three Aces and Four Aces would be separate winning combinations after the draw.

One alternative for Example 3 would be to use any of the other cards in the deck in place of the Aces. For example, the Deuces could be used and the predesignated winning combinations on the initial deal would be one, two, three or four Deuces instead of Aces. Another alternative embodiment of this Example 4 would be to use face cards instead of Aces as the prearranged winning combinations. The predesignated winning combinations on the initial deal would be one, two, three, four or five face cards.

Any suitable payout schedule can be used. This variation of the present invention described in Example 3 can be applied to any suitable "core game" played on a video poker machine.

EXAMPLE 4

Queens Follow Kings

This Example 4 of the present invention is representative of a predesignated arrangement of cards on the initial deal that is concerned with the order and location of the cards being initially dealt.

In this example, the predesignated winning combination for cards on the initial deal requires one or more Queens followed by a King, reading from left to right across the video screen. If the player is dealt one Queen with a King immediately adjacent and to the right of the Queen on the initial deal, the player receives a pre-established payout based on the number of coins wagered. If the player is dealt two, three or four Queens with a King immediately adjacent and to the right of the last Queen on the initial deal, the player receives different (and progressively higher) pre-established amounts based on the number of coins wagered.

After it has been determined whether the player has achieved one or more Queens with a King immediately adjacent on the right of the last Queen on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 4 of the method of the present invention would be:

TABLE 4

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| QQQQK (DEALT) | 50 | 100 | 150 | 200 | 250 |
| FOUR-OF-A-KIND | 25 | 50 | 75 | 100 | 125 |
| QQQK (DEALT) | 30 | 60 | 90 | 120 | 150 |
| FULL HOUSE | 6 | 12 | 18 | 24 | 30 |
| QQK (DEALT) | 5 | 10 | 15 | 20 | 25 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| QK (DEALT) | 5 | 10 | 15 | 20 | 25 |
| JACKS OR BETTER | 1 | 2 | 3 | 4 | 5 |

This variation of the present invention described in Example 4 is not limited to Queens followed by Kings. Alternatively, any one or more of a first designated card can be followed by any other second designated card. Or any one or more of a second designated card can be preceded by a first designated card.

Any suitable payout schedule can be used. This variation of the present invention described in Example 4 can be applied to any suitable "core game" played on a video poker machine.

EXAMPLE 5

Low Cards Only

In Example 5, the predesignated winning arrangement on the initial deal is all five cards being low cards (Nine down through Deuce) without making a pair. Thus, the player wins on the initial deal if all five of his cards are Nines down through Deuces and no two cards are the same.

In the preferred embodiment, a suggested payout table for this Example 5 of the method of the present invention would be:

TABLE 5

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| LOW CARDS NO PAIR (DEALT) | 10 | 20 | 30 | 40 | 50 |
| FULL HOUSE | 6 | 12 | 18 | 24 | 30 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |

TABLE 5-continued

| DRAW POKER | NUMBER OF COINS BET | | | | |
|---|---|---|---|---|---|
| POKER HAND | 1 | 2 | 3 | 4 | 5 |
| TWO PAIR | 2 | 4 | 6 | 8 | 10 |
| JACKS OR BETTER | 1 | 2 | 3 | 4 | 5 |

Any suitable payout schedule can be used. This variation of the present invention described in Example 5 can be applied to any suitable "core game" played on a video poker machine.

EXAMPLE 6

Joker's Revenge

Example 6 is representative of the method of the present invention in which one or more Jokers are used in particular predesignated winning card arrangements if the player receives those predesignated card arrangements on the initial deal. To the deck of fifty-two standard playing cards are added one or more Jokers which are designated as wild cards. A Royal Flush using a Joker as a wild card is predesignated as the winning card arrangement on the initial deal of five cards. If the player is dealt a Royal Flush using a Joker as a wild card, the player receives a pre-established payout based on the number of coins wagered.

After it has been determined whether the player has achieved a Royal Flush using a Joker as a wild card on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 6 using only one Joker added to the deck would be:

TABLE 6

| DRAW POKER | NUMBER OF COINS BET | | | | |
|---|---|---|---|---|---|
| POKER HAND | 1 | 2 | 3 | 4 | 5 |
| ROYAL FLUSH WITHOUT JOKER | 400 | 800 | 1200 | 1600 | 4000 |
| ROYAL FLUSH WITH JOKER (DEALT) | 1600 | 3200 | 4800 | 6400 | 8000 |
| FIVE-OF-A-KIND | 200 | 400 | 600 | 800 | 1000 |
| ROYAL FLUSH WITH JOKER (DRAWN) | 100 | 200 | 300 | 400 | 500 |
| STRAIGHT FLUSH | 50 | 100 | 150 | 200 | 250 |
| FOUR-OF-A-KIND | 15 | 30 | 45 | 60 | 75 |
| FULL HOUSE | 7 | 14 | 21 | 28 | 35 |
| FLUSH | 5 | 10 | 15 | 20 | 25 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |
| KINGS OR BETTER | 1 | 2 | 3 | 4 | 5 |

Any suitable payout schedule can be used. This variation of the present invention described in Example 6 can be applied to any suitable "core game" played on a video poker machine.

EXAMPLE 7

Deuces and Faces

Example 7 is representative of yet another method of the present invention in which particular arrangements of cards create a winning arrangement if the player receives those cards on the initial deal. In this example, four Deuces and a Face card of a standard deck of playing cards are predesignated as the winning arrangement. If the player is dealt all four Deuces and any face card on the initial deal, the player receives a pre-established payout based on the number of coins wagered.

After it has been determined whether the player has achieved four Deuces and a face card on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 7 of the method of the present invention would be:

TABLE 7

| BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| FOUR DEUCES AND A FACE CARD (DEALT) | 800 | 1600 | 2400 | 3200 | 4000 |
| STRAIGHT FLUSH | 50 | 100 | 150 | 200 | 250 |
| FOUR DEUCES AND A FACE CARD (DRAWN) | 200 | 400 | 600 | 800 | 1000 |
| FOUR ACES | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 9 | 18 | 27 | 36 | 45 |
| FLUSH | 7 | 14 | 21 | 28 | 35 |
| STRAIGHT | 5 | 10 | 15 | 20 | 25 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

In this Example 7, the payout schedule is based on the "core game" being Bonus Poker.

One alternative for Example 7 would be to use any of the other cards in the deck in place of the Deuces. For example, the Aces, Threes, Fours, etc. could be used and the predesignated winning combinations on the initial deal would be four Aces, Threes, Fours, etc. and a face card.

Any suitable payout schedule can be used. This variation of the present invention described in Example 7 can be applied to any suitable "core game" played on a video poker machine.

EXAMPLE 8

Bonus Poker with 7's

Example 8 is representative of yet another method of the present invention in which particular arrangements of cards create a winning arrangement if the player receives those cards on the initial deal. In this example, three or more 7's are predesignated as the winning arrangement. If the player is dealt three or more 7's on the initial deal, the player receives a pre-established payout based on the number of coins wagered.

After it has been determined whether the player has achieved three or more 7's on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 8 of the method of the present invention would be:

TABLE 7

| BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 80 | 160 | 240 | 320 | 400 |
| FOUR 2'S, 3'S OR 4'S | 40 | 80 | 120 | 160 | 200 |
| FOUR 5'S THRU KINGS | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE OR MORE 7'S (DEALT) | 3 | 6 | 9 | 12 | 15 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

In this Example 8, the payout schedule is based on the "core game" being Bonus Poker.

One alternative for Example 8 would be to use any of the other cards in the deck in place of the Sevens. For example, the Deuces, Threes, Fours, etc. could be used and the predesignated winning combinations on the initial deal would be three or more Deuces, Threes, Fours, etc.

Any suitable payout schedule can be used. This variation of the present invention described in Example 8 can be applied to any suitable "core game" played on a video poker machine.

EXAMPLE 9

Double Bonus Poker with 7's

Example 9 is representative of another method of the present invention in which particular arrangements of cards create a winning arrangement if the player receives those cards on the initial deal. This example is similar to Example 8, except that the "core game" used is Double Bonus Poker. In this Example 9, three or more 7's are predesignated as the winning arrangement. If the player is dealt three or more 7's on the initial deal, the player receives a pre-established payout based on the number of coins wagered.

After it has been determined whether the player has achieved three or more 7's on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 9 of the method of the present invention would be:

TABLE 9

| DOUBLE BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 10 | 20 | 30 | 40 | 50 |
| FLUSH | 7 | 14 | 21 | 28 | 35 |
| STRAIGHT | 5 | 10 | 15 | 20 | 25 |
| THREE OR MORE 7'S (DEALT) | 3 | 6 | 9 | 12 | 15 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

In this Example 9, the payout schedule is based on the "core game" being Double Bonus Poker.

One alternative for Example 9 would be to use any of the other cards in the deck in place of the Sevens. For example, the Deuces, Threes, Fours, etc. could be used and the predesignated winning combinations on the initial deal would be three or more Deuces, Threes, Fours, etc.

Any suitable payout schedule can be used. This variation of the present invention described in Example 9 can be applied to any suitable "core game" played on a video poker machine.

EXAMPLE 9A

Looney Twos

In this Example 9A, which is quite similar to Example 9, the Sevens are replaced by Deuces and the predesignated winning combination on the initial deal would be three or more Deuces. A suggested payout table for this Example 9A of the method of the present invention would be:

TABLE 9A

| DOUBLE DOUBLE BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR ACES WITH ANY 2, 3 OR 4 | 400 | 800 | 1200 | 1600 | 2000 |
| FOUR 2'S, 3'S OR 4'S WITH ANY ACE, 2, 3 OR 4 | 160 | 320 | 480 | 640 | 800 |
| FOUR ACES | 160 | 320 | 480 | 640 | 800 |
| FOUR 2'S, 3'S OR 4'S | 80 | 160 | 240 | 320 | 400 |
| FOUR 5'S THRU KINGS | 50 | 100 | 150 | 200 | 250 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE OR MORE DEUCES (DEALT) | 3 | 6 | 9 | 12 | 15 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

In this Example 9A, the payout schedule is based on the "core game" being Double Double Bonus Poker, however any suitable "core game" and any suitable payout schedule can be used.

EXAMPLE 10

Black Jack Poker

Example 10 is representative of the method of the present invention in which particular predesignated two or four card combinations create winning arrangements if the player receives those cards on the initial deal. In each deck of fifty-two standard playing cards there are two Black Jacks (the Jack of Clubs and the Jack of Spades) and two Black Aces (the Ace of Clubs and the Ace of Spades). The combination of the Ace of Spades and the Jack of Spades and the combination of the Ace of Clubs and the Jack of Clubs are predesignated as winning arrangements if the player is dealt one or both of these all black Black Jack combinations as part of the initial deal. If the player is dealt either one of these two all black Black Jack combinations on the initial deal, the player receives a pre-established payout based on the number of coins wagered. If the player is dealt both of these all black Black Jack combinations on the initial deal, the player receives a different (and higher) pre-established amount based on the number of coins wagered.

After it has been determined whether the player has achieved one or both of the all black Black Jack combinations on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 10 of the method of the present invention would be:

TABLE 10

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| DOUBLE BLACK JACK (DEALT) | 50 | 100 | 150 | 200 | 250 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| SINGLE BLACK JACK (DEALT) | 1 | 2 | 3 | 4 | 5 |
| JACKS OR BETTER | 1 | 2 | 3 | 4 | 5 |

In this Example 10, the Double Black Jack and the Single Black Jack are not separate winning combinations after the draw. Any suitable payout schedule can be used. This variation of the present invention described in Example 10 can be applied to any suitable "core game" played on a video poker machine. Furthermore, any pair of cards can be designated as the predesignated winning cards that will cause the player to receive a payout if that card is dealt to the player on the initial deal, such as two card combinations of all red cards (such as the red Aces/Jacks) or even two card combinations of the major suits (Spades and Hearts) or the minor suits (Diamonds and Clubs).

EXAMPLE 11

Hopscotch Poker

Example 11 is representative of another method of the present invention in which particular predesignated cards in sequence create a winning arrangement if the player receives those cards on the initial deal. In this example, the Deuce, Four, Six, Eight and Ten regardless of suit of a standard deck of playing cards are predesignated as the winning arrangement if the player is dealt those five cards in sequence (left-to-right or right-to-left) on the initial deal. If the player is dealt that five card sequence on the initial deal, the player receives a pre-established payout based on the number of coins wagered. If the player is dealt the Deuce, Four, Six, Eight and X (where X is any card) in sequence (left-to-right or right-to-left) on the initial deal, the player receives a different (and lower) pre-established amount based on the number of coins wagered.

After it has been determined whether the player has achieved one of the predesignated arrangements of this Example 11 on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 11 of the method of the present invention would be:

TABLE 11

| DRAW POKER | NUMBER OF COINS BET | | | | |
|---|---|---|---|---|---|
| POKER HAND | 1 | 2 | 3 | 4 | 5 |
| ROYAL FLUSH | 500 | 1000 | 1500 | 2000 | 8000 |
| 2-4-6-8-10 (DEALT) (IN SEQUENCE) | 200 | 400 | 600 | 800 | 1000 |
| 2-4-6-8-ANY (DEALT) (IN SEQUENCE) | 100 | 200 | 300 | 400 | 500 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 26 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

In this Example 11, the sequential hopscotch runs are not separate winning combination after the draw.

One alternative for Example 11 would be to use other sequential cards in the deck in place of the Deuce, Four, Six, Eight and Ten. For example, the Three, Five, Seven, Nine and Jack could be used.

Any suitable payout schedule can be used. This variation of the present invention described in Example 11 can be applied to any suitable "core game" played on a video poker machine.

EXAMPLE 12

Freebee Poker

This Example 12 is representative of another variation of the present invention using a predesignated arrangement of cards on the initial deal.

In this example, the predesignated winning combination for cards on the initial deal requires three or more Threes. If the player is dealt three or more Threes on the initial deal, the player receives a pre-established payout based on the number of coins wagered.

After it has been determined whether the player has achieved three or more Threes on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player. As a special payout in this Example 12, if the player holds the three Threes that he has received on the initial deal and draws to a Full House, the player receives a payout that is higher than the player would receives for any other Full House.

In the preferred embodiment, a suggested payout table for this Example 12 of the method of the present invention would be:

TABLE 12

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| THREE OR MORE 3'S (DEALT) | 5 | 10 | 15 | 20 | 25 |
| FULL HOUSE WITH 3'S | 20 | 400 | 600 | 800 | 100 |
| STRAIGHT FLUSH | 50 | 100 | 150 | 200 | 250 |
| FOUR-OF-A-KIND | 25 | 50 | 75 | 100 | 125 |
| FULL HOUSE | 6 | 12 | 18 | 24 | 30 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

This variation of the present invention described in Example 12 is not limited to Threes. Any of the thirteen ranked cards of a standard deck of playing cards can be used as the card designated as the winning three or more cards for the initial deal.

Any suitable payout schedule can be used. This variation of the present invention described in Example 12 can be applied to any suitable "core game" played on a video poker machine.

EXAMPLE 13

Royal Boat Launch

In this Example 13, the predesignated winning combination for cards on the initial deal requires a Three-of-a-Kind of Deuces through Sixes. If the player is dealt Three-of-a-Kind of Deuces through Sixes on the initial deal, the player receives a pre-established payout based on the number of coins wagered.

After it has been determined whether the player has achieved Three-of-a-Kind of Deuces through Sixes on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

As a special payout in this Example 13, if the player holds the Three-of-a-Kind that he has received on the initial deal and draws to a "Royal Boat Launch" (which is a Full House in which the other two cards are a pair of face cards [a pair of Jack, Queens or Kings]), the player receives a payout that is higher than the player would receives for any other Full House.

In the preferred embodiment, a suggested payout table for this Example 13 of the method of the present invention would be:

TABLE 13

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| THREE 2's thru 6's (DEALT) | 1 | 2 | 3 | 4 | 5 |
| ROYAL BOAT LAUNCH | 10 | 20 | 30 | 40 | 50 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 26 | 45 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

This variation of the present invention described in Example 13 is not limited to the specific combinations described. Any one or more of the thirteen ranked cards of a standard deck of playing cards can be used as the cards designated as the winning Three-of-a-Kind for the initial deal and any suitable other pair can be designated as the higher payout Full House when combined with the winning Three-of-a-Kind from the initial deal.

Any suitable payout schedule can be used. This variation of the present invention described in Example 13 can be applied to any suitable "core game" played on a video poker machine.

EXAMPLE 14

Stop Sign Poker

This Example 14 is representative of another variation of the present invention using a predesignated arrangement of cards on the initial deal.

In this example, the predesignated winning combination for cards on the initial deal requires four cards of the same suit (a Four Card Flush). If the player is dealt a Four Card Flush on the initial deal, the player receives a pre-established payout based on the number of coins wagered.

After it has been determined whether the player has achieved a Four Card Flush on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

As a special payout in this Example 14, if the player holds the Four Card Flush that he has received on the initial deal and draws to a Five Card Flush, the player receives a payout that is higher than the player would receives for any other Flush. In the more preferred embodiment of this Example 14 of the present invention, only one of the four suits, e.g. Diamonds, is designated as the eligible suit for the Four Card Flush on the initial deal. However, alternatively, two, three or all four suits can be designated as eligible suits for the Four Card Flush on the initial deal.

In the preferred embodiment, a suggested payout table for this Example 14 of the method of the present invention would be:

TABLE 14

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| 4 CARD FLUSH DIAMONDS (DEALT) | 1 | 2 | 3 | 4 | 5 |
| FLUSH DIAMONDS | 10 | 20 | 30 | 40 | 50 |
| STRAIGHT FLUSH | 50 | 100 | 150 | 200 | 250 |
| FOUR-OF-A-KIND | 25 | 50 | 75 | 100 | 125 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Any suitable payout schedule can be used. This variation of the present invention described in Example 14 can be applied to any suitable "core game" played on a video poker machine.

EXAMPLE 15

Mega Royals

This Example 15 is representative of another variation of the present invention using a predesignated arrangement of cards on the initial deal.

In this example, the predesignated winning combination for cards on the initial deal is a Royal Flush. If the player is dealt a Royal Flush on the initial deal, the player receives a pre-established payout based on the number of coins wagered.

After the player has been paid for this Royal Flush on the deal, the gaming machine is reset and, if the player holds the Royal Flush, the player also receives the appropriate payout amount for a regular Royal Flush (such as the player would receive had he drawn to a Royal Flush). If the player does not achieve a Royal Flush on the deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 15 of the method of the present invention would be:

TABLE 15

| DOUBLE BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| ROYAL FLUSH (DEALT) | 2400 | 4800 | 7200 | 9600 | 12000 |
| STRAIGHT FLUSH | 50 | 100 | 150 | 200 | 250 |
| FOUR ACES | 160 | 320 | 480 | 640 | 800 |
| FOUR 2's, 3's or 4's | 80 | 160 | 240 | 320 | 400 |
| FOUR 5's THRU KINGS | 50 | 100 | 150 | 200 | 250 |
| FULL HOUSE | 9 | 18 | 27 | 36 | 45 |
| FLUSH | 6 | 12 | 18 | 24 | 30 |
| STRAIGHT | 5 | 10 | 15 | 20 | 25 |
| THREE-OF-A-KIND | 3 | 6 | 9 | 12 | 15 |
| TWO PAIR | 1 | 2 | 3 | 4 | 5 |

TABLE 15-continued

| DOUBLE BONUS POKER | NUMBER OF COINS BET | | | | |
|---|---|---|---|---|---|
| POKER HAND | 1 | 2 | 3 | 4 | 5 |
| JACKS OR BETTER | 1 | 2 | 3 | 4 | 5 |

While the payout schedule shown in Table 15 is based on Double Bonus Poker, any suitable payout schedule can be used. This variation of the present invention described in Example 15 can be applied to any suitable "core game" played on a video poker machine.

EXAMPLE 16

Curved Straight

Example 16 is representative of another method of the present invention in which a particular predesignated cards in sequence create a winning arrangement if the player receives those cards on the initial deal. In this example, the Three, Four, Five and Six regardless of suit of a standard deck of playing cards is predesignated as the winning arrangement if the player is dealt those four cards in sequence (left-to-right or right-to-left) on the initial deal. If the player is dealt that four card sequence on the initial deal, the player receives a pre-established payout based on the number of coins wagered.

After it has been determined whether the player has achieved the predesignated Three, Four, Five and Six of this Example 16 on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player. If the player has held the sequential Three, Four, Five and Six, the player receives a special payout on the draw if the player receives a Deuce next to the Three or a Seven next to the Six (the "Curved Straight").

In the preferred embodiment, a suggested payout table for this Example 16 of the method of the present invention would be:

TABLE 16

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| 3-4-5-6 (DEALT) (IN SEQUENCE) | 3 | 6 | 9 | 12 | 15 |
| CURVED STRAIGHT | 10 | 20 | 30 | 40 | 50 |
| STRAIGHT FLUSH | 50 | 100 | 150 | 200 | 250 |
| FOUR-OF-A-KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

In this Example 16, the sequential four card straights are not separate winning combination after the draw.

One alternative for Example 16 would be to use other sequential cards in the deck in place of the Three, Four, Five and Six. For example, the Seven, Eight, Nine and Ten could be used.

Any suitable payout schedule can be used. This variation of the present invention described in Example 16 can be applied to any suitable "core game" played on a video poker machine.

EXAMPLE 17

Relay Pairs

This Example 17 is representative of another variation of the present invention using a predesignated arrangement of cards on the initial deal.

In this example, the predesignated winning combination for cards on the initial deal is a "Relay Pair". A "Relay Pair" can be Two Pair, a Full House or a Four-of-a-Kind of certain designated cards. For example, a "Relay Pair—2's thru 4's" can be Two Pair, a Full House or a Four-of-a-Kind in which the cards are from the 2's, 3's and 4's. A "Relay Pair—5's thru 10's" can be Two Pair, a Full House or a Four-of-a-Kind in which the cards are from the 5's thru 10's.

If the player is dealt a Relay Pair on the initial deal, the player receives a pre-established payout based on the number of coins wagered.

If the player does not achieve a Relay Pair on the deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 17 of the method of the present invention would be:

TABLE 17

| BONUS POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| RELAY PAIR 2'S THRU 4'S (DEALT) | 2 | 4 | 6 | 8 | 10 |
| RELAY PAIR 5'S THRU 10'S (DEALT) | 1 | 2 | 3 | 4 | 5 |
| STRAIGHT FLUSH | 50 | 100 | 150 | 200 | 250 |
| FOUR ACES | 160 | 320 | 480 | 640 | 800 |
| FOUR 2's, 3's or 4's | 80 | 160 | 240 | 320 | 400 |
| FOUR 5's THRU KINGS | 50 | 100 | 150 | 200 | 250 |
| FULL HOUSE | 9 | 18 | 27 | 36 | 45 |
| FLUSH | 6 | 12 | 18 | 24 | 30 |
| STRAIGHT | 5 | 10 | 15 | 20 | 25 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

While the payout schedule shown in Table 17 is based on Bonus Poker, any suitable payout schedule can be used. This variation of the present invention described in Example 17 can be applied to any suitable "core game" played on a video poker machine.

EXAMPLE 18

Best Bet Royals

Example 18 is representative of another variation of the present invention using a predesignated arrangement of cards on the initial deal.

In this example, the predesignated winning combinations for cards on the initial deal are a sequential five card Royal Flush in Spades, a sequential Four to a Royal Flush in Hearts and a sequential Four to a Royal Flush in Clubs. If the player is dealt one of these winning combinations on the initial deal, the player receives a pre-established payout based on the number of coins wagered.

After the player has been paid for this winning hand on the deal, the gaming machine is reset and, if the player holds the winning hand and draws to a Royal Flush, the player is also receives the appropriate payout amount for a regular Royal Flush. If the player does not achieve one of these winning hands on the deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 18 of the method of the present invention would be:

TABLE 18

| DRAW POKER | NUMBER OF COINS BET | | | | |
|---|---|---|---|---|---|
| POKER HAND | 1 | 2 | 3 | 4 | 5 |
| SPADE ROYAL FLUSH IN SEQUENCE R TO L DEALT) | 10000 | 20000 | 30000 | 40000 | 1,000,000 |
| ROYAL FLUSH IN SEQUENCE R TO L | 2500 | 5000 | 7500 | 10000 | 12500 |
| ROYAL FLUSH IN SEQUENCE L TO R | 2500 | 5000 | 7500 | 10000 | 12500 |
| 4 TO A ROYAL IN SEQUENCE IN HEARTS R TO L (DEALT) | 1500 | 3000 | 4500 | 6000 | 7500 |
| 4 TO A ROYAL IN SEQUENCE IN CLUBS L TO R (DEALT) | 1500 | 3000 | 4500 | 6000 | 7500 |
| 4 TO A ROYAL IN SEQUENCE IN DIAMONDS R TO L | 500 | 1000 | 1500 | 2000 | 2500 |
| 4 TO A ROYAL IN SEQUENCE IN SPADES L TO R | 500 | 1000 | 1500 | 2000 | 2500 |
| ANY ROYAL FLUSH IN SEQUENCE | 200 | 400 | 600 | 800 | 1000 |
| STRAIGHT FLUSH | 50 | 100 | 150 | 200 | 250 |
| FOUR OF A KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

While the payout schedule shown in Table 18 is based on Draw Poker, any suitable payout schedule can be used. This variation of the present invention described in Example 18 can be applied to any suitable "core game" played on a video poker machine.

EXAMPLE 19

Double Action Pairs

This Example 19 is representative of another variation of the present invention using a predesignated arrangement of cards on the initial deal.

In this example, the predesignated winning combination for cards on the initial deal is a "Double Action Pair". A "Double Action Pair" can be Two Pair, a Full House or a Four-of-a-Kind of certain designated cards in which the cards are from the 2's thru 6's.

If the player is dealt a Double Action Pair on the initial deal, the player receives a pre-established payout based on the number of coins wagered.

If the player does not achieve a Double Action Pair on the deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 19 of the method of the present invention would be:

TABLE 19

| DRAW POKER | NUMBER OF COINS BET | | | | |
|---|---|---|---|---|---|
| POKER HAND | 1 | 2 | 3 | 4 | 5 |
| ROYAL FLUSH | 500 | 1000 | 1500 | 2000 | 8000 |
| DOUBLE ACTION PAIRS 2'S THRU 6'S (DEALT) | 3 | 6 | 9 | 12 | 15 |
| STRAIGHT FLUSH | 50 | 100 | 150 | 200 | 250 |
| FOUR OF A KIND | 25 | 50 | 75 | 100 | 125 |

TABLE 19-continued

| DRAW POKER | NUMBER OF COINS BET | | | | |
|---|---|---|---|---|---|
| POKER HAND | 1 | 2 | 3 | 4 | 5 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

While the payout schedule shown in Table 19 is based on Draw Poker, any suitable payout schedule can be used. This variation of the present invention described in Example 19 can be applied to any suitable "core game" played on a video poker machine. The range of cards used for the Double Action Pairs can be modified as desired.

EXAMPLE 20

Red Coats are Coming

In Example 20, the predesignated winning arrangement on the initial deal is a four card Heart or Diamond flush. Thus, the player wins on the initial deal if four of his five cards are either Hearts or Diamonds.

In the preferred embodiment, a suggested payout table for this Example 20 of the method of the present invention would be:

TABLE 20

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FOUR CARD FLUSH HEARTS OR DIAMONDS (DEALT) | 1 | 2 | 3 | 4 | 5 |
| FULL HOUSE | 7 | 14 | 21 | 28 | 35 |
| FLUSH | 5 | 10 | 15 | 20 | 25 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Any suitable payout schedule can be used. This variation of the present invention described in Example 20 can be applied to any suitable "core game" played on a video poker machine. Furthermore, the winning combinations on the deal could be the two black suits (Spades and Clubs), the two major suits (Spades and Hearts) or the two minor suits (Diamonds and Clubs).

EXAMPLE 21

Waden 'n' Jokers

Example 21 is representative of another method of the present invention in which one or more Jokers are used in particular predesignated winning card arrangements if the player receives those predesignated card arrangements on the initial deal. To the deck of fifty-two standard playing cards are added one or more Jokers which are designated as wild cards. A Joker on the initial deal of the five cards is predesignated as the winning card arrangement. If the player is dealt a Joker on the initial deal, the player receives a pre-established payout based on the number of coins wagered.

After it has been determined whether the player has achieved a Joker on the initial deal, the game continues. The player holds those cards he wishes to keep and discards those cards he no longer wants. Replacement cards are dealt and displayed to the player so that his final five card hand is shown on the video screen. If this final five card hand results in a winning combination, the player is paid the amount shown on the payout schedule for that winning combination and the number of coins wagered by the player.

In the preferred embodiment, a suggested payout table for this Example 21 using only one Joker added to the deck would be:

TABLE 21

| DRAW POKER | NUMBER OF COINS BET | | | | |
|---|---|---|---|---|---|
| POKER HAND | 1 | 2 | 3 | 4 | 5 |
| ROYAL FLUSH WITHOUT JOKER | 500 | 1000 | 1500 | 2000 | 8000 |
| JOKER (DEALT) | 1 | 2 | 3 | 4 | 5 |
| FIVE-OF-A-KIND | 200 | 400 | 600 | 800 | 1000 |
| ROYAL FLUSH WITH JOKER | 100 | 200 | 300 | 400 | 500 |
| STRAIGHT FLUSH | 40 | 80 | 120 | 160 | 200 |
| FOUR-OF-A-KIND | 20 | 40 | 60 | 80 | 100 |
| FULL HOUSE | 5 | 10 | 15 | 20 | 25 |
| FLUSH | 4 | 8 | 12 | 16 | 20 |
| STRAIGHT | 3 | 6 | 9 | 12 | 15 |
| THREE-OF-A-KIND | 2 | 4 | 6 | 8 | 10 |
| TWO PAIR | 1 | 2 | 3 | 4 | 5 |
| KINGS OR BETTER | 1 | 2 | 3 | 4 | 5 |

Any suitable payout schedule can be used. This variation of the present invention described in Example 21 can be applied to any suitable "core game" played on a video poker machine. Furthermore, as another variation of this Example 21, a Joker in a particular location in the initially dealt hand can be designated as the winning arrangement.

EXAMPLE 22

Million Coin Poker

This variation of the present invention described in this Example 22 modifies the traditional manner of play of electronic video draw poker by adding a step prior to the implementation of the initial deal that occurs in a conventional five card draw video poker game.

Figure 1B:
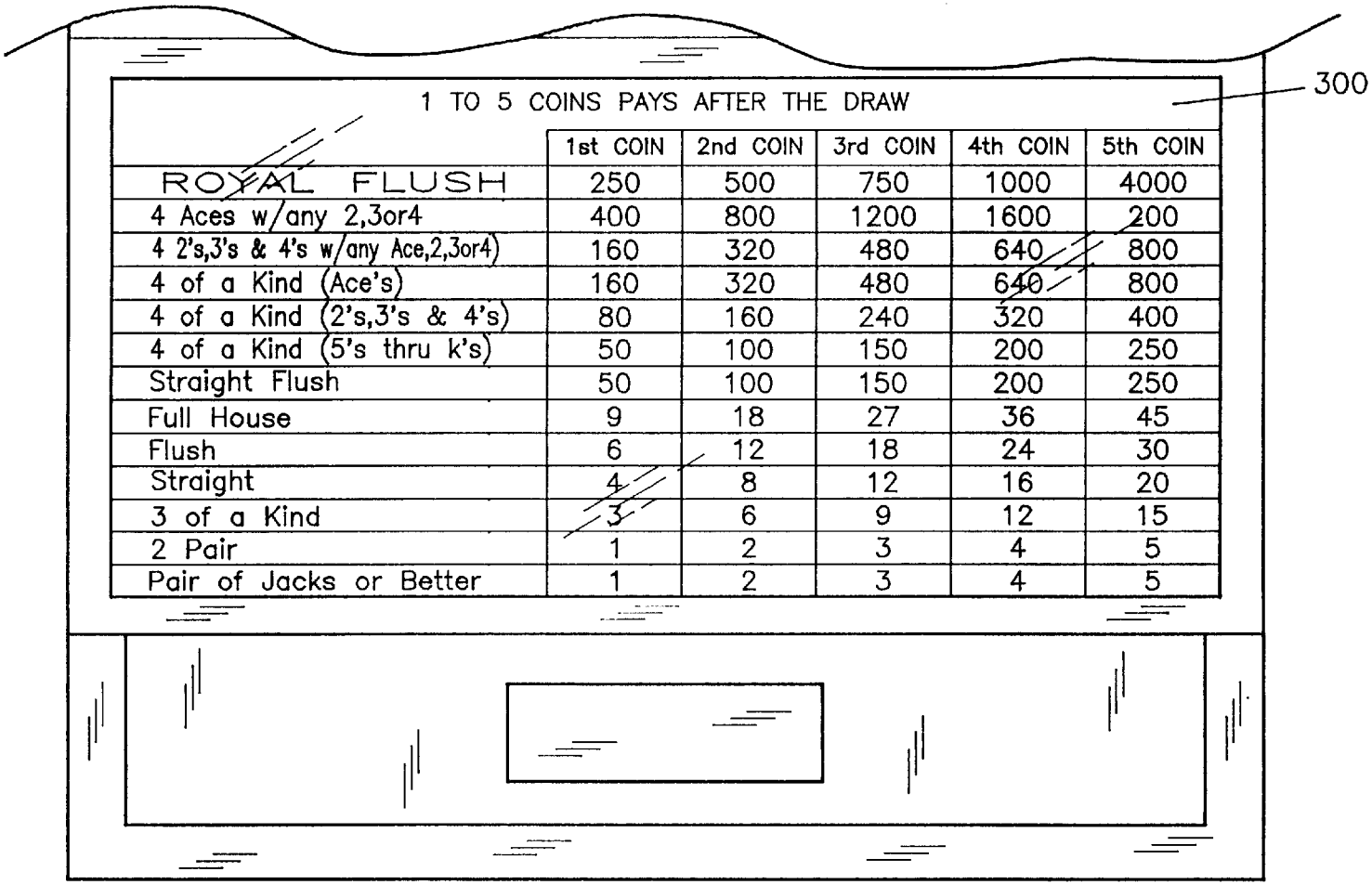
Figure 2:
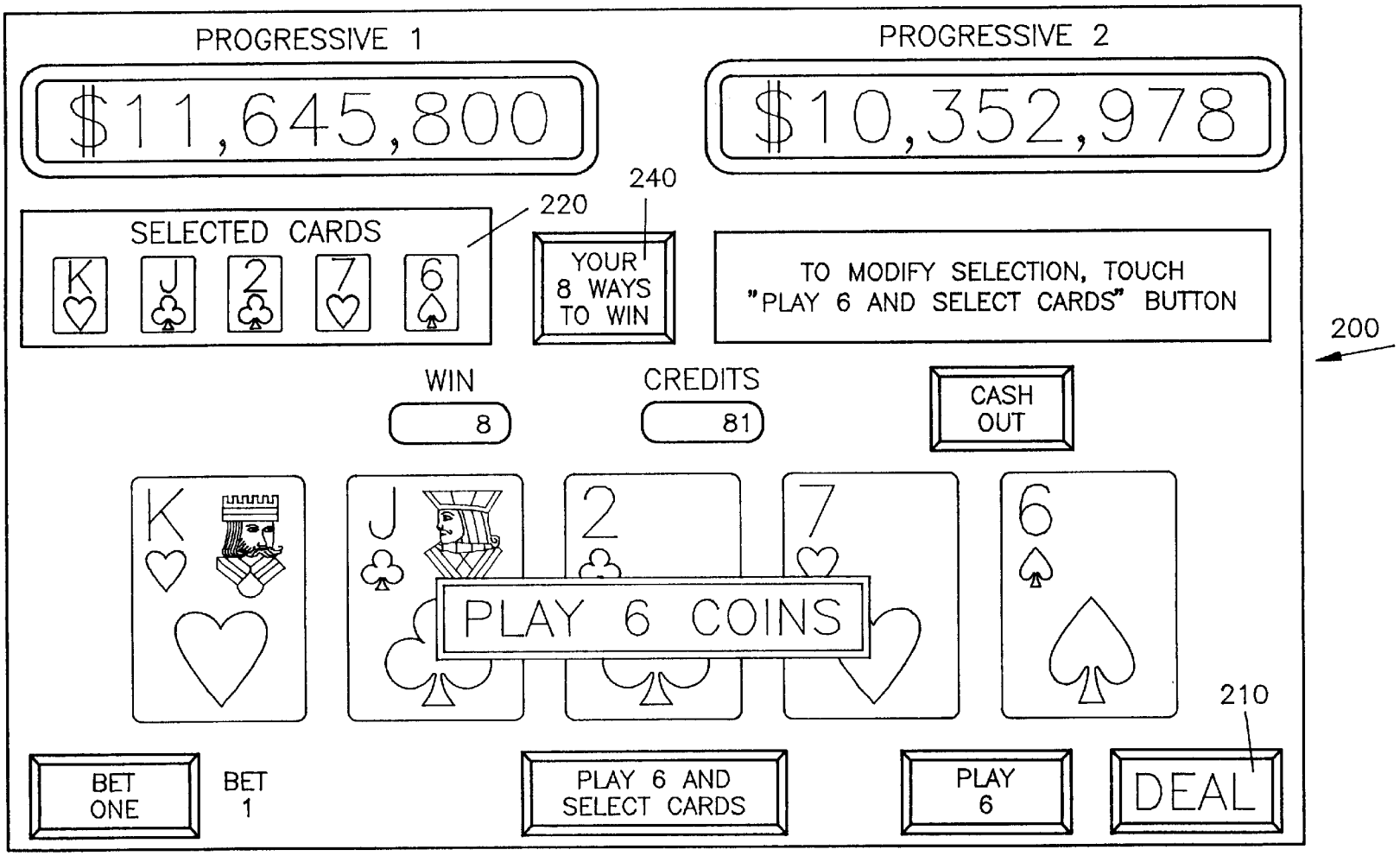
FIG. 2 shows an enlarged view of the screen display area of FIG. 1.

FIG. 1 shows an electronic gaming machine 100 configured to practice the method of Example 22. The gaming machine 100 includes a video display area 200 upon which various video screens are displayed during the course of the play of the game. Below the video display screen 200, there is provided a payout table 300 which is normally printed on belly glass and which displays to the player the various winning hand combinations upon which the player can win payouts for card combinations achieved after the hold and draw step of the game.

Above the video display screen 200, there is provided another payout table 400 which displays to the player the various winning combinations upon which the player can win payouts for card combinations achieved after the initial deal step of the game.

Figure 3:
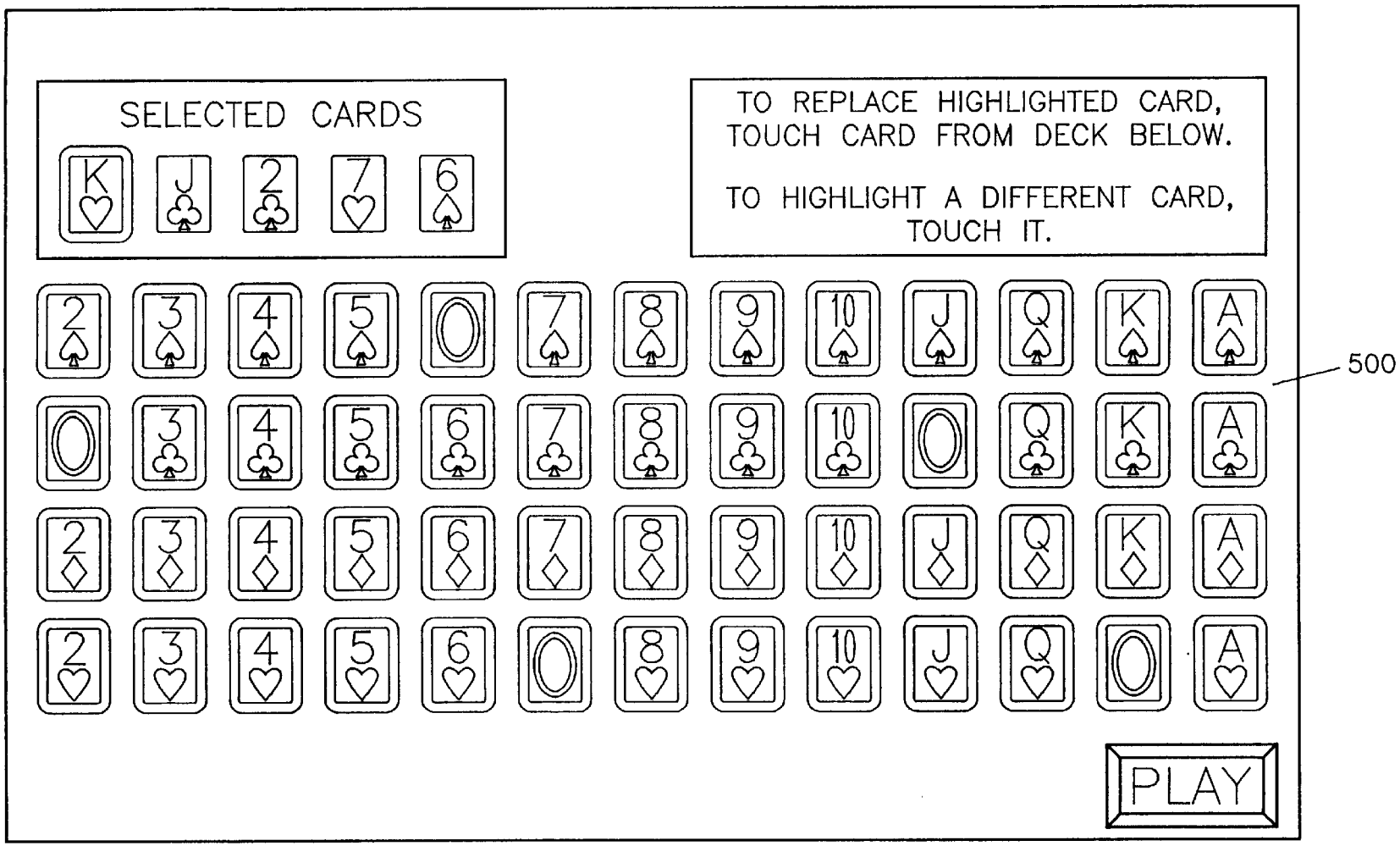
FIG. 3 shows a view of another screen display used in the method of Example 22 of the present invention.
Figure 4:
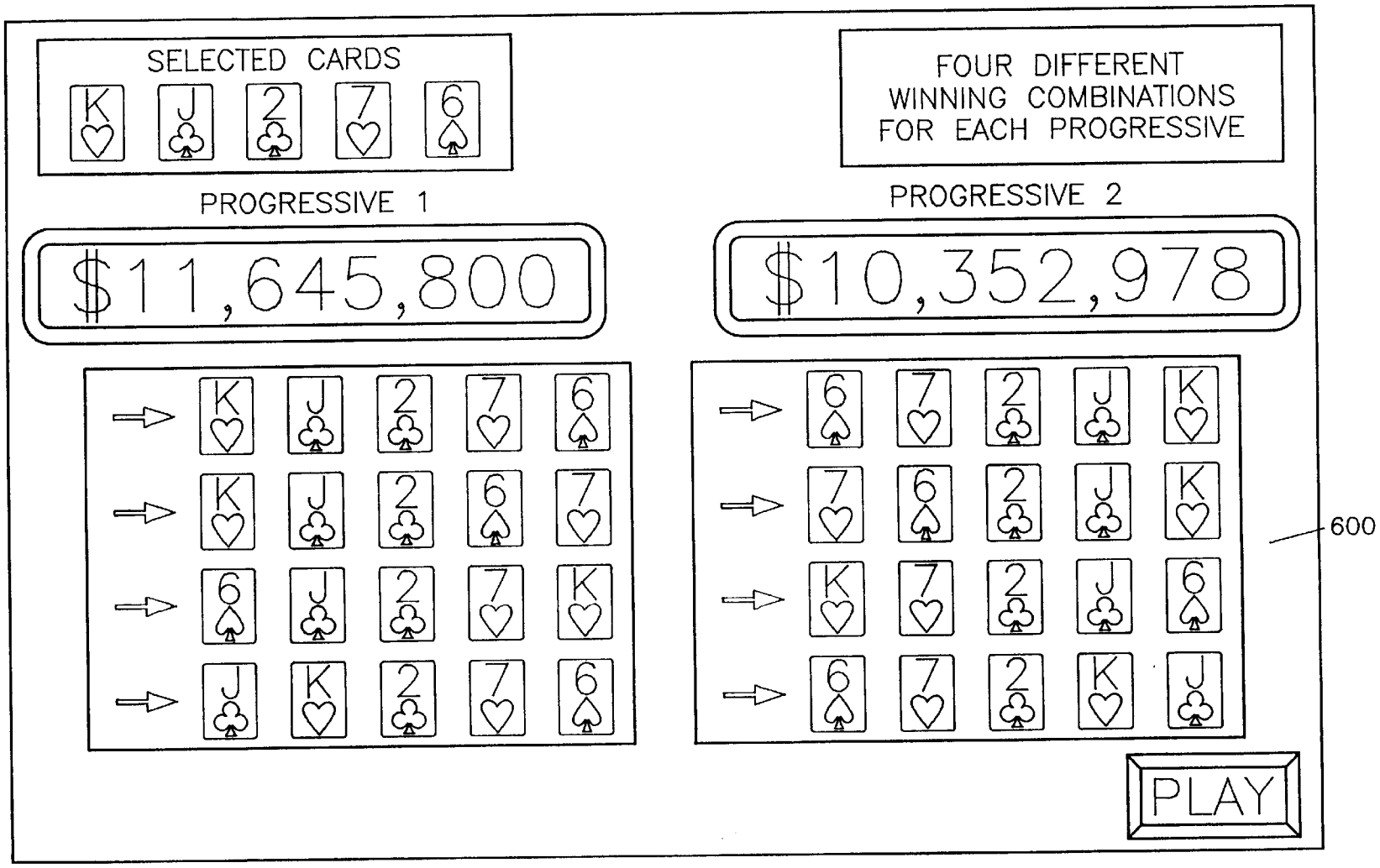
FIG. 4 shows a view of another screen display used in the method of Example 22 of the present invention.

After the player makes an initial wager to commence the game, all fifty-two cards from a standard deck of playing cards are displayed to the player on the video screen in a second video display shown at 500 in FIG. 3. The player selects five of these fifty-two cards to be the potential match cards when the initial five card draw poker hand is dealt.

Any suitable means can be used to select the five matching cards. For example, a touch screen can be used since touch screen technology has become quite prevalent in electronic video casino gaming equipment. Alternatively, a light pen could be used similar to the light pen technology that is used in video Keno apparatus. While somewhat cumbersome, a fifty-two button keypad could be added to the gaming apparatus to allow the five matching card selection to be done by pressing the appropriate buttons.

Once the player has selected the five matching cards that he wishes to be in play during the play of the five card draw poker game (in the example shown in FIG. 3, the player has selected the K♡, J♧, 2♧, 7♡ and 6♤, a third screen display 600 is shown in the video display area. This third screen display 600 shows the eight different sequences that the player can achieve to win one of the large progressive jackpots.

In the preferred embodiment of this Example 22, the player will win Progressive Jackpot #1 if the player is dealt all five of his selected cards with any three of the five cards in adjacent order reading from left-to-right. Also, the player will win Progressive Jackpot #2 if the player is dealt all five of his selected cards with any three of the five cards in adjacent order reading from right-to-left. During the course of the play of the game, the player can look at these eight winning combinations shown on the third screen display 600 in FIG. 3 by pressing location 240 on the screen display 200 shown in FIG. 1.

After the player has selected his five matching cards, the player presses the touch screen at the Deal location 210 on the gaming machine (or a conventional Deal button if buttons are used). Electronically, the five selected matching cards are displayed on a portion 220 (preferably in a corner or along the top) of the gaming machine display 200 and the unselected forty-seven cards are removed from the screen. Then, from a deck of shuffled playing cards, five face up cards are randomly dealt and displayed on the video screen representing the five card initial deal of a draw poker hand to the player.

If the first five cards from the initial deal match by card rank the five cards selected by the player, the player is awarded a payout. The player is awarded an even higher payout if all five cards match not only by card rank, but also with any three of the five cards in adjacent order reading from left-to-right or right-to-left.

EXAMPLE A

The player selects the following cards as the matching cards reading left to right in positions A, B, C, D and E: King of Hearts, Jack of Clubs, Deuce of Clubs, Seven of Hearts and Six of Spades. The deal of the initial five card draw poker hand can result in the following cards reading left to right: King of Hearts, Jack of Clubs, Deuce of Clubs, Seven of Hearts and Six of Spades. In this example, the initial deal of the five card draw poker hand results in all five matching cards having been dealt to the player. Additionally, since at least three of the five cards are in adjacent order reading left-to-right, the player would win Progressive Jackpot #1. In the preferred embodiment of this Example 22 of the present invention, this jackpot would be a progressive jackpot funded by the money wagered by the players, but a fixed amount jackpot could also be used.

EXAMPLE B

The player selects the following cards as the matching cards reading left to right in positions A, B, C, D and E: King of Hearts, Jack of Clubs, Deuce of Clubs, Seven of Hearts and Six of Spades. The deal of the initial five card draw poker hand can result in the following cards reading left to right: Six of Spades, Seven of Hearts, Deuce of Clubs, Jack of Clubs and King of Hearts. In this example, the initial deal of the five card draw poker hand results in all five matching cards having been dealt to the player. Additionally, since at least three of the five cards are in adjacent order reading right-to-left, the player would win Progressive Jackpot #2. In the preferred embodiment of this Example 22 of the present invention, this jackpot would be a progressive jackpot funded by the money wagered by the players, but a fixed amount jackpot could also be used.

EXAMPLE C

Figure 6:
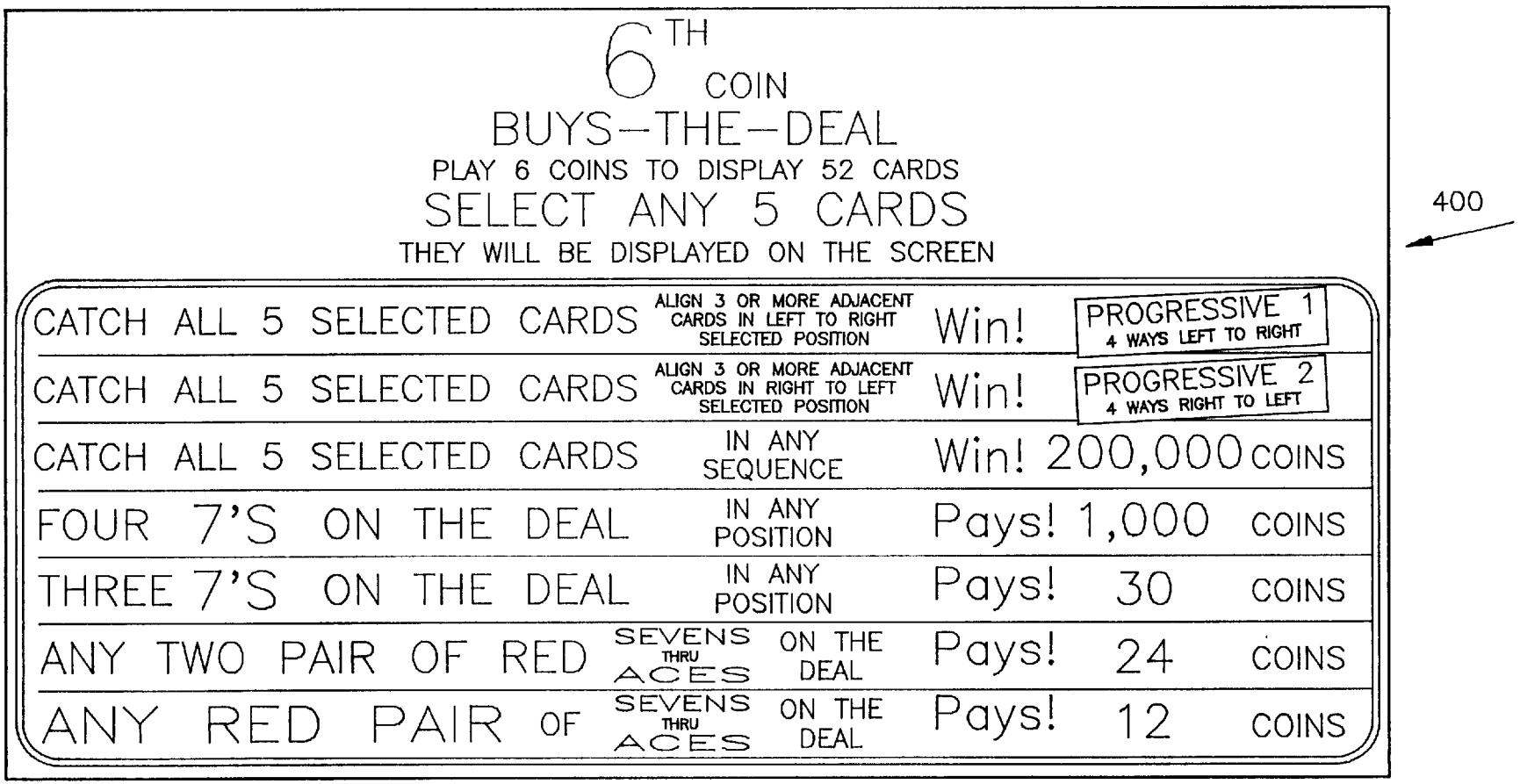
FIG. 6 shows an enlarged view of the upper portion of FIG. 1 showing the sixth coin pay table.

The player selects the following cards as the matching cards reading left to right in positions A, B, C, D and E: King of Hearts, Jack of Clubs, Deuce of Clubs, Seven of Hearts and Six of Spades. The deal of the initial five card draw poker hand can result in the following cards reading left to right: Jack of Clubs, King of Hearts, Seven of Hearts, Six of Spades and Deuce of Clubs. In this example, the initial deal of five card draw poker hand results in the cards located in the positions A, B, C, D and E reading left-to-right from the player-selected matching cards matching with the cards from initial draw poker hand, but not in sequence positions. In other words, the initial draw poker hand matches the cards selected by the player as matching cards on a five-to-five correlation based on card rank but not in position sequence. Because the odds of this happening are also quite high, a jackpot amount can be awarded to the player if this should occur. In the preferred embodiment, this jackpot would be any suitable fixed amount (in the example shown in FIGS. 1 and 6 in pay table 400, the winning amount is 200,000 coins), but a progressive jackpot funded by the money wagered by the players could also be used.

As an alternative or addition to method described above, jackpot amounts can be determined for any number of cards matching and being adjacent to each other. Also, jackpot amounts can be determined for any number of cards matching by card rank in one, two, three, four or all five of the card positions A, B, C, D and E when comparing the player selected matching cards to the five card initial deal. Still another alternative would be to award jackpot amounts for any number of cards from one to five matching by card rank regardless of the card positions.

The payouts can be fixed amounts or progressive jackpot amounts at the option of the operator of the gaming equipment. The progressive jackpot meters can be started at zero or seeded at an initial jackpot amount. In a conventional manner of other progressive jackpots used on electronic video gaming machines, a portion of each wager made by the player can be designated to each of the progressive jackpot meters which allows the progressive jackpot meters to increase in value. Alternatively, a separate wager can be required from the player in order to be eligible for this special payout on the deal. A portion of this separate wager can be allocated to the progressive jackpots and other payouts that are available on the deal, with the remainder of the separate wager going to the gaming establishment. When the player achieves the winning combination, the player is paid the amount of the progressive jackpot and the progressive jackpot is reset to the initial starting value.

The matching feature of the present invention and the use of progressive jackpot meters also lends itself to linking a plurality of the gaming machines of the present invention to common progressive jackpot meters so that the value of each of the progressive jackpots will increase more quickly.

In addition to the winning combinations that are provided between the player selected matching cards and the initial deal of the five card draw poker hand, other winning combinations can be provided just based on the initial draw of the five card poker hand. For example, as shown in the pay table 400 of FIGS. 1 and 6, if the initial deal of the five card poker hand results in four Sevens being dealt to the player, the player can be awarded a payout. Also, if the player is dealt three Sevens, the player can be awarded a smaller payout. Still also, if the player is dealt two pairs or one pair of red (Diamond or Heart) Sevens through Aces, the player can be awarded other smaller payouts.

In one preferred embodiment shown in pay table 400, four Sevens would pay 1,000 coins, three Sevens would pay 30 coins, two pairs of red Sevens through Aces would pay 24 coins and a pair of red Sevens through Aces would pay 12 coins. All of the payouts for card combinations received on the deal in the preferred embodiment of the present invention are shown in pay table 400 in FIGS. 1 and 6.

Other special initial deal payouts can be incorporated into this Example 22 of the present invention such as those described above in connection with the previous examples.

The use of the special matching payouts and the special initial deal payouts does not interfere with the normal play of the gaming machine. If the player achieves a matching payout or an initial deal winning combination payout, he is paid the amount of his winnings for that payout and the play of the method of the gaming machine continues in the conventional manner of a five card draw poker game. These special payouts are a separate aspect of the method of play of the invention and do not detract from the normal play of the game; in fact, it adds to the normal play of the game by giving the player an additional opportunity to win.

In the most preferred embodiment of the present invention, the player would insert five coins or tokens (or wager five credits) to play the conventional five card draw poker game. If the player wishes to be eligible for the special matching payouts or the special initial deal winning combinations, the player must wager a sixth coin (or credit). It is the sixth coin that is used to provide the funding for the special matching payouts and the special initial deal winning combination payouts. This enhances the appeal of this game to the players because the normal pay tables for the conventional draw poker game can be used.

The method of the present invention would proceed as follows: a player would insert five coins or tokens (or wager five credits) into an electronic gaming machine programmed to deal a game of video poker. Upon wagering the sixth coin, token or credit, a display of the standard fifty-two cards of a playing card deck is presented to the player on the video screen. The player selects five of those fifty-two cards by simply touching the screen at the location of the five desired cards (or using other available card selection techniques). These five cards are then aligned in a horizontal row at a location on the display screen and are considered the player's matching cards.

When the player hits the "Deal" button, five cards deck of playing cards would be displayed to the player on the video screen of the electronic gaming machine. If the player has an appropriate match between his selected matching cards and the five cards initially dealt as part of the five card draw poker hand, the player is awarded the appropriate payout. Or, if the initial five card draw poker hand is one of the special initial deal payout combinations, then the player is awarded that payout.

Whether the player wins or not on the initial deal, the conventional five card draw poker game then continues. By pressing the conventional toggle button for "Hold/Draw" on the panel of the machine beneath each card or by simply touching the screen locations of the cards the player wishes to hold, the player would select which cards to hold and which cards to discard. When the player then hits the "Draw" button, replacement cards are displayed for the discarded cards. The gaming machine determines whether a winning hand has been achieved and the player is awarded the number of coins corresponding to the winning hand and the number of coins wagered as shown in the payout schedule.

FIGS. 1 and 5 show at 300 an example of a pay table for the winning combinations after the draw step of the method of play. The pay table 300 shown in the example is a Double Double Bonus pay table, but any suitable pay table can be used.

The basic method of the present invention can also be applied to any of the myriad forms of video poker "core games," including both draw poker and stud poker games, and including games using a standard fifty-two card deck and a deck of playing cards with one or more Jokers added thereto. It is only necessary to mathematically compute an appropriate payout schedule based on the frequency of each type of winning hand combination occurring and the percentage payback to the player that is desired.

Similarly, the method of the present invention can be applied to a live poker game dealt by a dealer to a player or a number of players sitting at a gaming table. Finally, the method the present invention can be practiced without the aspect of gambling, but rather as an amusement game in which the players are awarded points for achieving winning hand combinations based on the payout schedule decided upon at the start of the game.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a poker game that only uses a player's hand to determine a winning or losing outcome comprising:

a) dealing an initial five card hand to the player from a deck of playing cards;

b) awarding the player a first predetermined amount if four cards of the initial five card hand comprises Four to a Royal Flush on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

2. The method of claim 1 in which the Four to a Royal Flush is in sequence.

3. The method of claim 1 in which the Four to a Royal Flush is in sequence from right-to-left and the suit is Hearts.

4. The method of claim 1 in which the Four to a Royal Flush is in sequence from left-to-right and the suit is Diamonds.

5. The method of claim 1 in which the deck of playing cards is a standard fifty-two card deck.

6. The method of claim 1 in which the deck of playing cards comprises a standard fifty-two card deck with at least one Joker added thereto.

7. The method of claim 1 in which the second predesignated arrangement of cards comprises a Four to a Royal Flush.

8. A method of playing a poker game that only uses a player's hand to determine a winning or losing outcome comprising:

a) dealing an initial five card hand to the player from a deck of playing cards;

b) awarding the player a first predetermined amount if four cards of the initial five card hand constitutes Four to a Straight Flush on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

9. The method of claim 8 in which the deck of playing cards is a standard fifty-two card deck.

10. The method of claim 8 in which the deck of playing cards comprises a standard fifty-two card deck with at least one Joker added thereto.

11. A method of playing a poker game that only uses a player's hand to determine a winning or losing outcome comprising:

a) dealing an initial five card hand to the player from a deck of playing cards;

b) awarding the player a first predetermined amount if four cards of the initial five card hand constitutes Four to a Flush on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

12. The method of claim 11 in which the deck of playing cards is a standard fifty-two card deck.

13. The method of claim 11 in which the deck of playing cards comprises a standard fifty-two card deck with at least one Joker added thereto.

14. A method of playing a poker game that only uses a player's hand to determine a winning or losing outcome comprising:

a) dealing an initial five card hand to the player from a deck of playing cards;

b) awarding the player a first predetermined amount if four cards of the initial five card hand constitutes Four to a Straight on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

15. The method of claim 14 in which the deck of playing cards is a standard fifty-two card deck.

16. The method of claim 14 in which the deck of playing cards comprises a standard fifty-two card deck with at least one Joker added thereto.

17. A method of playing a poker game that only uses a player's hand to determine a winning or losing outcome comprising:

a) dealing an initial five card hand to the player from a deck of playing cards;

b) awarding the player a first predetermined amount if three cards of the initial five card hand constitutes Three to a Straight Flush on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

18. The method of claim 17 in which the deck of playing cards is a standard fifty-two card deck.

19. The method of claim 17 in which the deck of playing cards comprises a standard fifty-two card deck with at least one Joker added thereto.

20. A method of playing a poker game that only uses a player's hand to determine a winning or losing outcome comprising:

a) dealing an initial five card hand to the player from a deck of playing cards;

b) awarding the player a first predetermined amount if three cards of the initial five card hand constitutes Three to a Flush on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

21. The method of claim 20 in which the deck of playing cards is a standard fifty-two card deck.

22. The method of claim 20 in which the deck of playing cards comprises a standard fifty-two card deck with at least one Joker added thereto.

23. A method of playing a poker game that only uses a player's hand to determine a winning or losing outcome comprising:

a) dealing an initial five card hand to the player from a deck of playing cards;

b) awarding the player a first predetermined amount if three cards of the initial five card hand constitutes Three to a Straight on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

24. The method of claim 23 in which the deck of playing cards is a standard fifty-two card deck.

25. The method of claim 23 in which the deck of playing cards comprises a standard fifty-two card deck with at least one Joker added thereto.

26. A method of playing a poker game that only uses a player's hand to determine a winning or losing outcome comprising:

a) dealing an initial five card hand to the player from a deck of playing cards;

b) awarding the player a first predetermined amount if at least one card of the initial five card hand constitutes a Jack of Hearts or a Jack of Spades on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

27. The method of claim 26 in which the deck of playing cards is a standard fifty-two card deck.

28. The method of claim 26 in which the deck of playing cards comprises a standard fifty-two card deck with at least one Joker added thereto.

29. The method of claim 26 in which two cards of the initial five card hand constitutes a Jack of Hearts and a Jack of Spades on the initial deal.

30. A method of playing a poker game that only uses a player's hand to determine a winning or losing outcome comprising:

a) dealing an initial five card hand to the player from a deck of playing cards;

b) awarding the player a first predetermined amount if at least one card of the initial five card hand constitutes an Ace on the initial deal;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

31. The method of claim 30 in which the deck of playing cards is a standard fifty-two card deck.

32. The method of claim 30 in which the deck of playing cards comprises a standard fifty-two card deck with at least one Joker added thereto.

33. The method of claim 30 in which at least two cards of the initial five card hand constitute Aces on the initial deal.

34. The method of claim 30 in which at least three cards of the initial five card hand constitute Aces on the initial deal.

35. The method of claim 30 in which at four cards of the initial five card hand constitute Aces on the initial deal.

36. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if at least a first card of the initial five card hand constitutes a predesignated first rank and a subsequent card immediately adjacent the first card in the display of cards constitutes a predesignated second rank different from said rank;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

37. The method of claim 36 in which the deck of playing cards is a standard fifty-two card deck.

38. The method of claim 36 in which the deck of playing cards comprises a standard fifty-two card deck with at least one Joker added thereto.

39. The method of claim 36 in which the predesignated first rank is a Queen and the predesignated second rank is a King.

40. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if at least two first cards of the initial five card hand constitutes a predesignated first rank and a subsequent card immediately adjacent the last of the two first cards in the display of cards constitutes a predesignated second rank different from said first rank;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

41. The method of claim 40 in which the deck of playing cards is a standard fifty-two card deck.

42. The method of claim 40 in which the deck of playing cards comprises a standard fifty-two card deck with at least one Joker added thereto.

43. The method of claim 40 in which the predesignated first rank is a Queen and the predesignated second rank is a King.

44. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if at least three first cards of the initial five card hand constitutes a predesignated first rank and a subsequent card immediately adjacent the last of the three first cards in the display of cards constitutes a predesignated second rank different from said first rank;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

45. The method of claim 44 in which the deck of playing cards is a standard fifty-two card deck.

46. The method of claim 44 in which the deck of playing cards comprises a standard fifty-two card deck with at least one Joker added thereto.

47. The method of claim 44 in which the predesignated first rank is a Queen and the predesignated second rank is a King.

48. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if four first cards of the initial five card hand constitutes a predesignated first rank and a subsequent card immediately adjacent the last of the four first cards in the display of cards constitutes a predesignated second rank different from said first rank;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

49. The method of claim 48 in which the deck of playing cards is a standard fifty-two card deck.

50. The method of claim 48 in which the deck of playing cards comprises a standard fifty-two card deck with at least one Joker added thereto.

51. The method of claim 48 in which the predesignated first rank is a Queen and the predesignated second rank is a King.

52. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if all of the cards of the initial five card hand have a rank of nine or less and none of the cards of the initial hand are a pair;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

53. The method of claim 52 in which the deck of playing cards is a standard fifty-two card deck.

54. The method of claim 52 in which the deck of playing cards comprises a standard fifty-two card deck with at least one Joker added thereto.

55. A method of playing a poker game that only uses a player's hand to determine a winning or losing outcome comprising:

a) dealing an initial five card hand to the player from a deck of playing cards and displaying the initial five card hand to the player, the deck of playing cards comprising a standard fifty-two card deck with at least one Joker added thereto;

b) awarding the player a first predetermined amount if the cards of the initial five card hand comprise a Royal Flush with one of the cards being a Joker;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

56. A method of playing a poker game that only uses a player's hand to determine a winning or losing outcome comprising:

a) dealing an initial five card hand to the player from a deck of playing cards and displaying the initial five card hand to the player, the deck of playing cards comprising a standard fifty-two card deck with at least one Joker added thereto;

b) awarding the player a first predetermined amount if one of the cards of the initial five card hand constitutes a Joker;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

57. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise Four-of-a-Kind and a Face card;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

58. The method of claim 57 in which the deck of playing cards is a standard fifty-two card deck.

59. The method of claim 57 in which the deck of playing cards comprises a standard fifty-two card deck with at least one Joker added thereto.

60. The method of claim 57 in which the Four-of-a-Kind is four Deuces.

61. The method of claim 57 in which the second predesignated arrangement of cards comprises a Four-of-a-Kind and a Face card.

62. The method of claim 61 in which the Four-of-a-Kind is four Deuces.

63. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise at least a Three-of-a-Kind;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

64. The method of claim 63 in which the deck of playing cards is a standard fifty-two card deck.

65. The method of claim 63 in which the deck of playing cards comprises a standard fifty-two card deck with at least one Joker added thereto.

66. The method of claim 63 in which the Three-of-a-Kind is three Sevens.

67. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise an Ace of Spades and a Jack of Spades;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

68. The method of claim 67 in which the deck of playing cards is a standard fifty-two card deck.

69. The method of claim 67 in which the deck of playing cards comprises a standard fifty-two card deck with at least one Joker added thereto.

70. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise an Ace of Clubs and a Jack of Clubs;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

71. The method of claim 70 in which the deck of playing cards is a standard fifty-two card deck.

72. The method of claim 70 in which the deck of playing cards comprises a standard fifty-two card deck with at least one Joker added thereto.

73. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise an Ace of Spades, a Jack of Spades, an Ace of Clubs and a Jack of Clubs;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

74. The method of claim 73 in which the deck of playing cards is a standard fifty-two card deck.

75. The method of claim 73 in which the deck of playing cards comprises a standard fifty-two card deck with at least one Joker added thereto.

76. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise in sequence a Deuce, a Four, a Six and an Eight;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

77. The method of claim 76 in which the deck of playing cards is a standard fifty-two card deck.

78. The method of claim 76 in which the deck of playing cards comprises a standard fifty-two card deck with at least one Joker added thereto.

79. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise in sequence a Deuce, a Four, a Six, an Eight and a Ten;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

80. The method of claim 79 in which the deck of playing cards is a standard fifty-two card deck.

81. The method of claim 79 in which the deck of playing cards comprises a standard fifty-two card deck with at least one Joker added thereto.

82. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprises a Royal Flush;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

83. The method of claim 82 in which the deck of playing cards is a standard fifty-two card deck.

84. The method of claim 82 in which the deck of playing cards comprises a standard fifty-two card deck with at least one Joker added thereto.

85. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise in sequence a four card straight;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

86. The method of claim 85 in which the deck of playing cards is a standard fifty-two card deck.

87. The method of claim 85 in which the deck of playing cards comprises a standard fifty-two card deck with at least one Joker added thereto.

88. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise in sequence a five card straight;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

89. The method of claim 88 in which the deck of playing cards is a standard fifty-two card deck.

90. The method of claim 88 in which the deck of playing cards comprises a standard fifty-two card deck with at least one Joker added thereto.

91. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise a pre-established two pairs;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

92. The method of claim 91 in which the pre-established two pair are from the group consisting of Deuces, Threes and Fours.

93. The method of claim 91 in which the pre-established two pair are from the group consisting of Deuces, Threes, Fours, Fives and Sixes.

94. The method of claim 91 in which the pre-established two pair are from the group consisting of Fives, Sixes, Sevens, Eights, Nines and Tens.

95. The method of claim 91 in which the deck of playing cards is a standard fifty-two card deck.

96. The method of claim 91 in which the deck of playing cards comprises a standard fifty-two card deck with at least one Joker added thereto.

97. A method of playing a poker game that only uses a player's hand to determine a winning or losing outcome comprising:

a) dealing an initial five card hand to the player from a deck of playing cards and displaying the initial five card hand to the player;

b) awarding the player a first predetermined amount if the cards of the initial five card hand comprise a four card flush in either Hearts or Diamonds;

c) the player selecting which, if any, of the cards from the initial five card hand the player wishes to discard;

d) dealing replacement cards from the deck of playing cards for the cards discarded resulting in a final five card hand; and e) awarding the player a second predetermined amount if at least a portion of the final five card hand constitutes a second predesignated arrangement of cards.

98. The method of claim 97 in which the deck of playing cards is a standard fifty-two card deck.

99. The method of claim 97 in which the deck of playing cards comprises a standard fifty-two card deck with at least one Joker added thereto.

* * * * *